US009810485B2

(12) United States Patent
Barnes et al.

(10) Patent No.: US 9,810,485 B2
(45) **Date of Patent: *Nov. 7, 2017**

(54) HEAT EXCHANGER II

(71) Applicant: Hiflux Limited, Middlesex (GB)

(72) Inventors: David Barnes, London (GB); Tanzi Besant, Buckinghamshire (GB); Albert Demargne, Richmond (GB); Keith Pullen, London (GB)

(73) Assignee: Hiflux Limited, Middlesex (GB)

( * ) Notice: Subject to any disclaimer, the term of this patent is extended or adjusted under 35 U.S.C. 154(b) by 712 days.

This patent is subject to a terminal disclaimer.

(21) Appl. No.: 14/310,788

(22) Filed: Jun. 20, 2014

(65) Prior Publication Data

US 2014/0299299 A1 Oct. 9, 2014

Related U.S. Application Data

(63) Continuation of application No. 12/946,340, filed on Nov. 15, 2010, now Pat. No. 8,776,869, which is a (Continued)

(30) Foreign Application Priority Data

Jan. 7, 2005 (GB) ..... 0500302.5
Jan. 5, 2006 (WO) ..... PCT/GB2006/000026

(51) Int. Cl.
*F28D 1/03* (2006.01)
*F28D 9/00* (2006.01)
(Continued)

(52) U.S. Cl.
CPC ..... *F28F 3/08* (2013.01); *F28D 1/0333* (2013.01); *F28D 9/0012* (2013.01);
(Continued)

(58) Field of Classification Search
CPC ..... F28D 1/03; F28D 9/0012; F28D 9/0031; F28D 9/0068; F28D 9/0087;
(Continued)

(56) References Cited

U.S. PATENT DOCUMENTS 1,549,619 A 8/1925 Steenstrup
1,630,895 A 5/1927 Herbst
(Continued)

FOREIGN PATENT DOCUMENTS

EP 1153653 A1 11/2001
GB 626866 7/1949
(Continued)

OTHER PUBLICATIONS

"Final Office Action" dated May 8, 2009 in related U.S. Appl. No. 11/774,089.
(Continued)

*Primary Examiner* — Len Tran
*Assistant Examiner* — Hans Weiland
(74) *Attorney, Agent, or Firm* — Kaplan Breyer Schwarz, LLP

(57) ABSTRACT

A heat exchanger comprises a stack of mutually spaced apart plates. The plates are separated by respective spacings therebetween. Alternate spacings respectively provide a flow path for a first fluid and a second fluid. The heat exchanger further comprises a first header for inflow of the first fluid and a second header for outflow of the first fluid. The first and second headers are connected to the plate stack by flexible tubular ducting means.

25 Claims, 12 Drawing Sheets

Related U.S. Application Data continuation of application No. 11/774,089, filed on Jul. 6, 2007, now abandoned.

(51) Int. Cl.
*F28F 3/08* (2006.01)
*F28F 9/02* (2006.01)
*F28F 3/02* (2006.01)

(52) U.S. Cl.
CPC ..... *F28D 9/0031* (2013.01); *F28D 9/0068* (2013.01); *F28F 3/022* (2013.01); *F28F 9/0221* (2013.01); *F28F 9/0275* (2013.01)

(58) Field of Classification Search
CPC ..... F28F 2265/32; F28F 2275/14; F28F 2275/143; F28F 2275/146; F28F 3/022; F28F 3/08; F28F 9/0221; F28F 9/0275
See application file for complete search history.

(56) References Cited

U.S. PATENT DOCUMENTS

| | | | | |
|---|---|---|---|---|
| 2,040,947 | A | | 5/1936 | Mojonnier et al. |
| 2,057,298 | A | | 10/1936 | Feldmeier |
| 2,280,133 | A | | 4/1942 | Sundbach |
| 2,401,918 | A | | 6/1946 | Elder et al. |
| 2,449,369 | A | | 9/1948 | Doane |
| 2,867,242 | A | | 1/1959 | Harris et al. |
| 3,255,816 | A | | 6/1966 | Rosenblad |
| 3,443,548 | A | | 6/1969 | Rich et al. |
| 3,527,291 | A | | 9/1970 | Neary et al. |
| 3,666,423 | A | | 5/1972 | Muenger |
| 3,718,182 | A | | 2/1973 | Rossetti |
| 3,842,904 | A | | 10/1974 | Gardenier |
| 3,942,589 | A | | 3/1976 | Opitzer |
| 4,433,723 | A | | 2/1984 | Parker |
| 5,097,897 | A | | 3/1992 | Watanabe et al. |
| 5,582,241 | A | * | 12/1996 | Yoho ..... F28F 9/0221 165/149 |
| 5,695,007 | A | | 12/1997 | Fauconnier et al. |
| 6,640,579 | B2 | | 11/2003 | Matsushima et al. |
| 7,325,594 | B2 | | 2/2008 | Wilhelm et al. |

FOREIGN PATENT DOCUMENTS

| | | | |
|---|---|---|---|
| JP | H037888 | A | 1/1991 |
| JP | H11159703 | A | 6/1999 |
| JP | H11223303 | A | 8/1999 |
| JP | 2000081287 | A | 3/2000 |
| JP | 2003041946 | | 2/2003 |
| JP | 2003269822 | A | 9/2003 |
| WO | 9607467 | A1 | 3/1996 |
| WO | 2004113802 | A1 | 12/2004 |

OTHER PUBLICATIONS

"Final Office Action" dated Aug. 28, 2013 in related U.S. Appl. No. 12/946,340.
"Final Office Action" dated Sep. 15, 2009 in related U.S. Appl. No. 11/774,089.
"Final Office Action" dated Oct. 31, 2008 in related U.S. Appl. No. 11/774,089.
"Search Report", dated May 24, 2005, Published in: GB.
Satu Tschubel, "International Search Report and Written Opinion" dated Apr. 21, 2006 in corresponding International Application No. PCT/GB2006/000026, Published in: GB.
"Non-Final Office Action" dated Feb. 20, 2013 in related U.S. Appl. No. 12/946,340.
"Non-Final Office Action" dated Mar. 19, 2008 in related U.S. Appl. No. 11/774,089.
"Non-Final Office Action" dated May 13, 2010 in copending U.S. Appl. No. 11/774,089.
"Notice of Allowance" dated Mar. 6, 2014 in related U.S. Appl. No. 12/946,340.

* cited by examiner

HEAT EXCHANGER II

RELATED APPLICATIONS

This application is a continuation of U.S. patent application Ser. No. 11/774,089, filed Jul. 6, 2007, the disclosure of which application is hereby incorporated by reference herein in its entirety.

BACKGROUND OF THE INVENTION

The present invention relates to a plate heat exchanger and in particular, to a new form of means for channeling fluid flow to and from the core of the heat exchanger.

Stacked plate structures are one of the most common configurations in heat exchanger design. The alternate spacings between adjacent plates form, respectively, the hot and cold fluid flow paths. Heat transfer occurs across the plates which are usually made of appropriately heat conductive metal. To enhance the surface area available for heat exchange, fins, pins or other surface projections are often provided in such designs.

The higher the operating temperature and/or pressure of such a heat exchanger, the greater become the stresses on the unit, including the ducting for conveying fluids to and from the heat exchanger stack. The plates require a combination of strength and the ability to flex such that the exchanger is able to maintain its physical integrity. This can place severe constraints on the design of whatever means is provided to convey the relevant fluids to and from the stack since such means needs to be in close physical proximity to, and physically attached to, the plate structure.

We have now devised an arrangement of fluid feeds which is particularly robust at relative extremes of heat exchanger operation.

Thus, a first aspect of the present invention now provides a heat exchanger comprising a stack of mutually spaced apart plates separated by respective spacings therebetween, wherein alternate spacings respectively provide a flow path for a first fluid and a second fluid, the heat exchanger further comprising a first header for inflow of the first fluid and a second header for outflow of the first fluid, the first and second headers being connected to the plate stack by tubular ducting means.

Any pair of plates, the spacing between which constitutes the, or part of the first fluid flow path may be considered to constitute a "cell".

The tubular ducting means is flexible to the extent that it maintains sufficient strength yet is able to flex appropriately to take account of movement of the plates during heat exchanger start-up and operation. Tubular ducting means of this kind may constitute spring means. Preferably, the tubular ducting means comprises respective tubes connecting the spacings representing the first fluid flow path with the insides of the first and second headers. Such tubes can be flexible by virtue of any of the following: their wall thicknesses and diameters, the materials from which they are made, their overall lengths and/or by virtue of being arranged to follow a tortuous path.

When the flexibility of the tubes is by virtue of them following a tortuous path and/or by virtue of their overall lengths, typically they will be made of a suitable metallic material. When at least part of the flexibility is due to the material from which the tubes are made, it is possible that they will be made from a rubber or synthetic rubber or other polymeric material, at least in part, optionally strengthened with a metallic sheet or filament. However, such tubes of flexible material are more suited to low temperature and/or low pressure applications.

The situation where at least part, preferably all, of the flexibility of the tubes is due to them following a tortuous path, this tortuous path may comprise one or more features. It may comprise a curved portion. Additionally or alternatively, it may comprise a portion having at least one helical turn. Yet again, additionally or alternatively, it may comprise an angled region, e.g. a bend between two substantially straight portions. It may comprise a bowed section. A plurality of substantially straight portions may be in a generally "zigzag" arrangement. When comprising a curved portion, the curvature thereof may be a curve through anything from (say) 10° up to 180°, or even more. A bend of an angled region, may be through as little as (say) 15° up to, for example, about 60°. In the case of the tortuous path involving any curve, bend (angle) or helical turn, it may comprise two or more of any of these. In many embodiments, respective pairs or groups, i.e. two or more flexible ducting means, e.g. in the form of tubes, may connect each cell with a particular header. When there is a pair, the shapes of each in the pair may be symmetrical with respect to each other, i.e. about an axis of symmetry which may be substantially parallel to the direction of flow in the first fluid flow path. Each may, for example, have any of the forms recited herein.

A typical plate configuration is generally square or rectangular, with at least two opposite sides preferably being substantially straight and parallel to the direction of the first fluid flow path. Those sides may be joined respectively at either end of the flow path, by two connecting sides. Those connecting sides may be substantially straight or may be curved, e.g. in a convex fashion.

One arrangement of connection of tubes to the first fluid flow path is when the tubes communicate at one or both ends of the first fluid flow path with one or both of the two opposite sides which are substantially parallel to the direction of the first fluid flow path (i.e. at the sides, preferably at the end(s)). However, they may instead communicate with one or both the connecting sides. In the latter case, preferably, they may connect with the first fluid flow path at the connecting side(s) via a (respective) common duct, e.g. at a position substantially at the mid-point of the connecting side(s).

Preferably, the mean hydraulic diameter of each tube is from 0.5 to 2 times the average plate-to-plate distance of the spacings representing the first fluid flow path. The term "hydraulic diameter" has the meaning well known in the art.

Preferably also, the average length of the tubes is from 0.1 to 2 times the width of the plates normal to the flow direction of the first fluid flow path.

Alternate spacings between the plates respectively define the first and second fluid flow paths and thus, the respective fluids for the most part, flow in a single direction between the plates but the directions of fluid flow for the first and second fluids need not be the same and are preferably directed counter-flow to one another. The ducting means is preferably arranged to direct inflow of the first fluid to the spacings which define the first fluid flow path in a direction which is from 90° to 30°, for example from 85° to 50° relative to the direction of flow of the first fluid in the first fluid flow path. In such an arrangement, preferably flow diverting means is placed in the first fluid flow paths between the aforementioned angled inflow from the ducting means and the body of the first fluid flow path itself. This is to enhance uniformity of flow between the plates. This may, for example, comprise a plurality of projections, baffles or the like, extending between mutually facing plate surfaces which define the boundaries of the respective spacings which make up the first fluid flow path. However, as will be explained further herein below, a preferred form of construction of heat exchanger entails use of projections such as pins extending across the first fluid flow path between the plates, substantially throughout the area of the mutually facing plate surfaces bounding the first fluid flow path, to improve heat transfer. These pins are preferably arranged in staggered fashion from one row to an adjacent row. The first two rows of pins in such an arrangement, immediately encountered by the inflow of the first fluid, can also function as flow diverting means as described above. Similarly, the last two rows of pins encountered by the first fluid before exit from the stack of plates, can also have a beneficial effect in respect of fluid flow and mixing and efficient exit of the first fluid from the plate stack. However, additionally or alternatively, outflow diverting means such as other projections or baffles may also be provided at the outflow end.

The ducting means, especially in the form of individual tubes, may form the sole means of physical connection between the headers and the plates. However, it is preferred to provide respective support members between either or both of the first and second headers and the plates and most preferably, these support members allow relative movement between the headers and the plates. In one particularly preferred class of embodiments, this is allowed by virtue of the support members comprising respective jointing means. In one such arrangement hereinafter described, these jointing means allow movement between the headers and the plates with at least one degree of freedom. In one preferred embodiment, the jointing means at a first end of the heat exchanger intended to run hotter, allows only one or more rotational degree of freedom but no translational degrees of freedom. Jointing means at the other end of the heat exchanger may allow at least one rotational degree of freedom but also, at least one translational degree of freedom. This ensures that the ducting means at the first (hot) end is subject to less deformation due to thermal expansion of the plates, than is the ducting means at the other (cold) end, where the allowable stress levels are greater.

The present invention is especially suited to arrangements wherein the first header is connected to a source of the first fluid and means are provided for feeding the second fluid from a source of second fluid to the second flow path, wherein the first fluid at source has a pressure equal to or greater than that of the second fluid at source.

In one class of embodiments, the plates are substantially parallel to each other and the stack of plates is substantially cubic or rectangular. In other classes of embodiment, the plates can be arranged in radial fashion or in an involute arrangement. The latter classes are advantageous for integration of the device with a turbine or other engine.

A second aspect of the present invention provides a heat exchanger comprising a stack of mutually spaced apart plates separated by respective spacings therebetween, wherein alternate spacings respectively provide a flow path for a first fluid and a second fluid, the heat exchanger further comprising a first header for inflow of the first fluid and a second header for outflow of the first fluid, the first and second headers being connected to the plate stack by tubular ducting means, wherein the plates are flat and are arranged in radial fashion.

A third aspect of the present invention provides a heat exchanger comprising a stack of mutually spaced apart plates separated by respective spacings therebetween, wherein alternate spacings respectively provide a flow path for a first fluid and a second fluid, the heat exchanger further comprising a first header for inflow of the first fluid and a second header for outflow of the first fluid, the first and second headers being connected to the plate stack by tubular ducting means, wherein the plates are curved and in substantially involute arrangement.

In most cubic rectangular or other stacked planar arrangements, or indeed in any other arrangement, e.g. radial or involute form, it may also be advantageous for the headers to be connected by pusher bars and preferably, these pusher bars are hingeably connected to each header. For example, a pusher bar can be located at each end of the stack of plates, connecting the two headers. This ensures that the headers can also move relative to each other during operation.

Preferably, additional means are provided for increasing the surface area available for heat transfer, such as pins or fins extending from or bridging the surfaces of the plates in the flow paths. In one particular form of arrangement, pairs of plates are bridged by pins extending through the plates (either physically extending there through or in fact, being integral with the plates).

In heat exchangers which utilize such a pin arrangement, the plates, each having respective first and second heat transfer surfaces on reverse sides thereof, are preferably arranged in a plurality of groups, each comprising at least two plates, pin means being provided comprising a plurality of groups of pins, the pins of each pin group being arranged to bridge plates of a respective plate group. Although it is preferred for substantially all plates in such a heat exchanger to have a pin configuration as described above, optionally, the heat exchanger may also contain plates not fitting this definition and/or other structures, especially other heat exchange structures.

A heat exchanger according to the present invention preferably comprises at least 2, e.g. 10 or more groups of plates and preferably, at least some of these are joined by pins. There is no upper limit to the number of the plates members as a whole but depending on application, this could go up to 100's or 1,000's, e.g. 10,000. However units having from 6 to 600 plates are typical. There is also no upper limit to the total number of plate groups.

In those structures employing pins, they may extend from one heat transfer surface of at least one plate (but preferably all the plates in that group) which are substantially in-line with those extending from the other heat transfer surface at that plate. Alternatively, the pins extending from the one heat transfer surface may be radially staggered (i.e. offset) with respect to those extending from the other heat transfer surface.

It is advantageous for any pin means also to comprise outer pins extending from the outermost heat transfer surfaces of at least one group of plates, said further pins terminating in respective pin free ends. Preferably, a gap is provided between the ends of the pins from one group and the ends of the pins from an adjacent group. Preferably, the respective fluids flowing between alternate gaps between plates is such that for those gaps in which the ends of such pin segments are located, the fluid pressure is lower than in the alternate spacings between plates through which the pin members extend in unbroken manner.

Each plate group may consist of two plates but groups of more than two plates may be joined by individual pin members, preferably sets of any even numbers of plates such as four, six, eight or more. Again, it is preferred for a gap to be arranged between ends of pins in one such group of joined plates and the ends of pins extending through an adjacent group. When the pins are radially offset or staggered between rows, most preferably, pins which have mutually facing ends separated by a gap are nevertheless, substantially in-line with each other. However, at least some pins with mutually facing ends could be offset (staggered).

The size of any such gap between pin ends is preferably from 1% to 50%, more preferably from 2% to 20% of the size of the gap between the plates through which those pin segments extend to terminate in the respective ends.

Preferably, such pins are solid but a hollow or honeycomb structure would also be possible. Preferably also, in cross-section, the pins are cylindrical but other cross-sectional shapes such as elliptical, polygonal or aerofoil shapes are also possible and in general, the invention is not limited to any particular shape. Further, it is not absolutely necessary for all pins to have the same cross-sectional shape and/or the same cross-sectional diameter. For example, the pin diameter may vary locally to accommodate technical and manufacturing constraints, or the pin array could consist of pins of smaller diameter alternating with pins of larger diameter within a single row. Nor is it indeed necessary for the pins to be purely cylindrical along their axis. The pin cross-section may vary in size and shape along its axis, e.g. tapered or circular at the ends but having an aerofoil shape in the middle. One form of tapering which is possible is tapering so as to be wider at the ends, narrowing towards the middle.

To enhance aerodynamic flow around the pins and/or their heat transfer capacity, some or all of the pins may exhibit irregularities such as protrusions or ribs (e.g. circular or helical ribs) or may otherwise have their surface area increased by roughening, e.g. with application of an appropriate coating such as that applied by vapor aluminizing, or by other surface treatment such as blasting.

The pins are preferably arranged in rows normal to the direction of fluid flow but the pins in alternate rows are preferably mutually staggered relative to those in the corresponding adjacent row(s) so that when viewed from above, the ends of the pins appear to be positioned at the apexes of a triangle (e.g. a substantially equilateral triangle) with one side substantially normal to the flow direction. The ratio of the pitch of the side normal (or most nearly normal) to the flow to that of the axial pitch of the pins can vary, for example, from 0.4 to 4, more preferably from 1 to 1.2, which corresponds to pins arranged in a preferably substantially equilateral array with one side preferably substantially normal to the flow. However, another configuration is also possible whereby the "side" of this nominal triangle is at an oblique angle relative to the direction of flow.

In the case of cylindrical pins, preferably their mean cross-sectional diameter is from 0.1 mm to 10 mm, more preferably from 0.5 mm to 3 mm. The mean plate thickness is preferably from 0.1 mm to 3 mm.

The spacing between adjacent plates in any one group is preferably substantially constant over the area of the plates and preferably also, from one inter-plate spacing to the next. However, these spacings may vary in some instances. Preferably also, the spacing between plates in a group is substantially the same as that in one or more, preferably all, other groups. The spacing between different pairings of plates does not necessarily have to be the same. The spacing between adjacent plates containing pin ends is preferably from 0.1 to 100 times the mean cross-sectional diameter, more preferably from 1 to 10 times. The spacing between plates which are completely bridged by individual pins or pin members is preferably from 0.1 to 100 times the mean cross-sectional diameter, more preferably from 1 to 10 times.

Preferably, the ratio of the mean spacing between plates defining the first fluid path in a central region of the exchanger to the mean spacing between plates defining the second fluid path in the same region is from 1:100 to 100:1, preferably from 1:10 to 10:1.

The most preferred cross-sectional shape of plate is generally or substantially rectangular. However, other shapes are possible. Preferably though, all or most of the plates have substantially the same shape. Preferably, they are of substantially uniform thickness.

It is convenient to fabricate the heat exchanger as a modular arrangement wherein it is manufactured in the form of modules or units, each comprising a fraction of the total number of plates, with appropriate ducting to lead the two fluid streams into and out of each module. This allows flexibility in configuring a total size of heat exchanger to a particular application requirement. It is also advantageous from the maintenance point of view. Such a modular arrangement may simply comprise a casing in which the modules are stacked. In the case of a gas turbine, such modules could be arranged circumferentially relative to the turbine shaft.

In the broadest sense, the plates and/or any surface projections such as fins or pins may respectively be made from any of metallic, ceramic or composite materials. More specifically they may be fabricated from high temperature alloys, for example of the type commonly used for fabrication of turbine blades. Alternatively, high temperature ceramics may be used. For less demanding pressure and temperature applications, the pins or analogous structures may be fabricated from the same material as the plates. However, individual pins may be made of different pin materials than the material(s) of other pins, progressively along the direction of fluid flow, e.g. nickel alloy at one end and stainless steel at the other. This has a cost advantage in that relatively expensive materials need only be used for pins exposed to the most stressful conditions during operation. The material of the pins may be of progressively graded composition or comprise discrete groups of different composition.

Depending on the material in question the method of manufacture may be sheet metal fabrication or extrusion, welding (e.g. laser welding) photo chemi-etching, casting or superplastic forming with diffusion bonding. The latter is more suitable for intended use at intermediate or high temperatures. Alternatively, the pin and plate arrangement may be manufactured using sintering onto an appropriately formed substrate to create a ceramic structure. Construction from a composite such as a carbon fiber composite is also possible.

With techniques such as welding, pins or analogous projections may extend through the plate or plates by physically protruding through holes formed therein. With techniques such as photo chemi-etching, the pins may be formed integrally with the plate or plates. The techniques giving rise to one or other such structure will be well known to persons skilled in the art. It is also possible for a heat exchanger according to the present invention to contain pin means respectively in both forms.

Pins or similar projections may also be formed "integrally" with a plate in the sense that they only extend from one surface thereof but are welded or brazed at least one end to a heat transfer surface of a plate. In a variant of that technique, one end of each pin can be inserted in a respective hole in each plate to be substantially flush with a surface thereof and then welded or brazed in place. In these techniques, welding or brazing can be applied to either or both place surfaces.

Thus, for example, the joining of the pins to the plate or plates and sealing of one fluid from the other can be achieved by means of laser welding. Alternatively, a coating such as mentioned above (e.g. vapor aluminizing) may also be used to bond the pins to the plates and seal the two fluids from each other.

In the case of radially staggered pins respectively extending from opposing surfaces of a plate, this is especially suited to "integral" formation of pins by welding or brazing. Brazing is normally only possible on an exposed plate surface not rendered inaccessible by an adjacent plate. The pins can be welded to one or both surfaces of a first plate and then a second adjacent such plate can be placed against the free ends of pins of the first plate and e.g. welded from the reverse side. The reverse side welding is made possible because the pins are not in-line from one side of the plate, relative to the other. The alternative technique of brazing is possible when the pins are inserted at one end thereof into holes in the plates so as to be flush with the remote side. In a variant of this technique, when plates are brought together, some of the pins (e.g. half of them) may be pre-attached to one plate and some to the other. Welding or brazing is then performed on those sides of the plates which are reverse to the bridged sides.

A preferred bonding technique is welding, in particular laser welding. This is because the weld is then of high integrity and is capable of sealing the two fluids from one another. The process also leads to the formation of asperities at regular or irregular intervals around the circumference of the pin(s) in the vicinity of the weld. These asperities are beneficial to heat transfer.

Heat exchangers according to the present invention can confer in addition to the aforementioned structural advantages, significant benefits in the aerodynamic and heat transfer performance of the device.

Preferred embodiments of the invention are designed to maximize the amount of heat transfer occurring in a high-performance core, whilst maintaining a satisfactory level of overall pressure loss. This is achieved by reducing considerably the dimensions of the so-called feeder sections that distribute and collect the high-pressure fluid from the cell. In conventional designs, these feeder sections typically represent a significant proportion of the size of the overall heat exchanger matrix, but yet are lossier and less effective at heat transfer than the core itself.

The design enables high pressure flow to be directed to the cell (plate stack) and collected from the cell via small bore tubes that connect the cell to the cold and hot end manifolds, respectively. At the cold end, the high pressure flow can be directed into the cell via a nozzle and a very small triangular feeder area (typically representing less than 2% of the core area; which is at least an order of magnitude greater for more conventional designs). The tube and nozzle may be set at an angle to the cell (angle between 0° and 60°). The high pressure flow then may exit the nozzle at relatively high-velocity to be channeled by the pins which are preferably provided in rows through the core, bridging and extending through pairs of plates (integral with these), preferably in rows wherein pins in any row are offset with respect to those in any adjacent row.

The angle at which the tube and nozzle are set depends primarily on the geometry of the pin array (overall width, pin size and spacing) and the amount of flow to be distributed. The distribution of flow into such a pin is sensitive to detailed geometrical features of the feeder and around the nozzle. In particular, it is important that flow separations around the nozzle exit are minimized, so that the jet of high pressure air does not deviate excessively from the nozzle direction.

Such an arrangement is also an efficient fluid mixing system so that the high pressure flow profile through the core rapidly becomes uniform (typically, after 5% of the axial length of the core). Although described above in terms of pins, this method of distribution of the high pressure flow into the array is also effective if the pins are replaced with fins, vanes or other regular, e.g. cylindrical shapes set into an array.

At the hot end, the high pressure flow exits the last row of pins and finds its way through a series of slots, the size of which increases from the edge of the core to the centerline. The flow may then be collected in a small rectangular feeder area (typically less than 2% of the core area) before being extracted through the small bore tubes to the hot end manifold. The use of graduated slots between the core and exit feeder can ensure that flow uniformity is maintained for as long as possible within the core. As with the cold end, less than 5% of the core is normally affected by non-uniformity at the hot end. Although the graduated slots have been described here, other arrangements of fins and slots exist which deliver a similar level of flow uniformity.

In effect, heat exchangers according to the present invention provide a means of rapidly distributing the flow to and collecting it from the plate stack that also ensures flow uniformity. An additional advantage of the design is that the very small size of the feeder sections means that there is little differential temperature pick up (edge to centerline) by the high pressure flow, the low pressure flow being effectively two-dimensional. This is unlike conventional feeders where, because of their significant size, fluid flowing along their shorter dimension picks up much less heat than fluid flowing along the longer dimension. This sets up transverse temperature gradients within the cores, which lead to transverse heat "leakage" and represent a penalty on performance.

With heat exchangers according to the present invention, the high degree of flow and temperature uniformity means that the cell is essentially two-dimensional. This is one of the more important advantages of the design, since it means that the performance of the core constituted by the plate stack will be free from the penalty of flow and temperature maldistribution, and hence close to the optimum. It also means that the core is considerably more amenable to analysis, which facilitates design.

The heat exchanger of any aspect of the present invention is especially suited for use with a power producing apparatus. The power producing apparatus may comprise a gas turbine. In fact, an especially preferred embodiment of the present invention is a recuperator for a gas turbine.

The performance of recuperators is quantified primarily in terms of heat exchange effectiveness and the associated pressure loss. The effectiveness of a recuperator is a measure of the percentage of heat extracted from the hot exhaust gas and transferred into the cooler air from the compressor. A good recuperator should have an effectiveness of over 75%, preferably about 90%. Pressure loss in the recuperator must be kept low, as it tends to reduce the expansion ratio through the turbine, which in turn is detrimental to the power output. Pressure losses should be below 10%, ideally below 5%.

The presence of a recuperator greatly enhances the efficiency of the type of small gas turbines that are used for distributed power generation. Typically, current unrecuperated microturbines operate at efficiencies of under 20% compared to around 30% or more for the recuperated cycle. Waste heat in the exhaust from the recuperator can be used to provide domestic heating (combined heat and power) which effectively further improves the efficiency for the end user. However, significant improvements in overall efficiency require hotter turbine operating temperatures and thus hotter turbine exhaust temperatures than current recuperators can handle.

Alternatively the heat exchanger may be applied to a turbocharger or a supercharger of a reciprocating engine power producer. The heat exchanger may be used to cool air, and desirably after compression of the air in the turbocharger or super-charger, before the air enters the reciprocating power producer.

In an alternative embodiment the invention provides a boiler with a heat transfer mechanism in the form of a heat exchanger apparatus according to the present invention.

Another power source where a heat exchanger according to the present invention may find application is a fuel cell. For example, the heat from a cell that runs at elevated temperature may be used to preheat the air and fuel entering the cell. This minimizes the heat that has to be provided by other means to bring the fuel cell up to its operating temperature.

In a further embodiment of the present invention heat exchanger apparatus according to the invention is used to preheat gas, prior to expansion of the gas in a gas expander. High pressure gas is sometimes used to drive a turbine driven electrical power generator. Preheating the gas prior to expansion increases the power output and may prevent the formation of ice particles in the turbine expander.

The present invention may also be claimed in terms of a heat exchanger according to the present invention connected to a supply of the respective first and second fluids, either of which may be liquid or gas.

Any heat exchanger according to any of the first, second and third aspects of the present invention may incorporate any one or more essential, preferred or specifically described features of any heat exchanger according to either or both of the other aspects of the invention.

The present invention will now be described in more detail by way of the following description of the preferred embodiments and with reference to the accompanying drawings in which.

In the following embodiments, the heat exchanger components may be formed of any material appropriate to the specific intended application, having regard to the operational temperature. However, example materials include stainless steel (such as SS 316) or a nickel-based alloy (such as Inconel 625).

Figure 1:
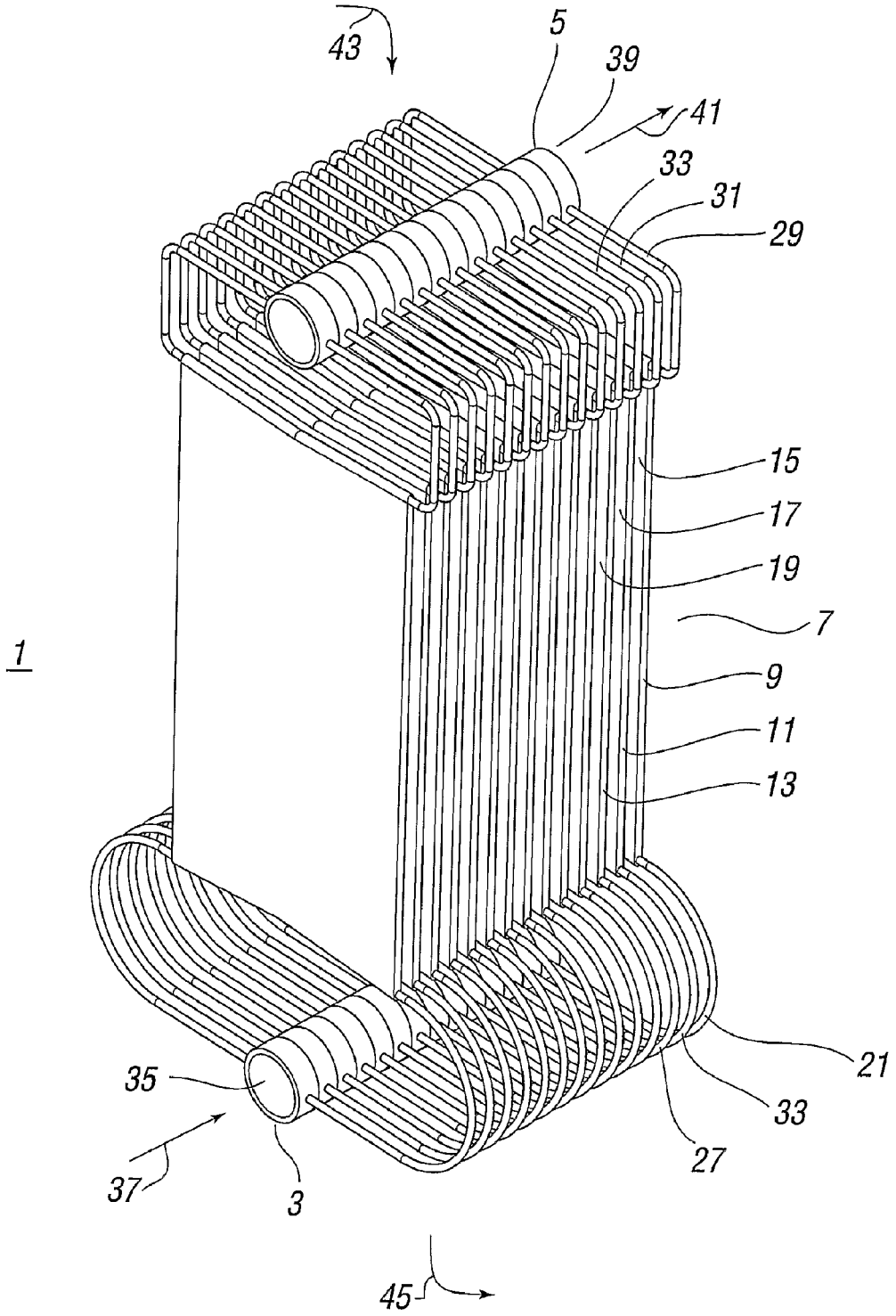
FIG. 1 shows a perspective view of a first embodiment of a heat exchanger according to the present invention.

There is shown in FIG. 1, a first embodiment of a heat exchanger 1 according to the present invention. A first header (pipe) 3 is arranged for inflow of a first cooling fluid and a second header (pipe) 5 is arranged for the outflow of that first fluid, after it has been heated in the heat exchanger. The body of the heat exchanger consists of a stack 7 of mutually spaced-apart substantially rectangular plates arranged between the inflow header 3 and the outflow header 5 of the first fluid with opposite edges respectively facing the headers. The plates are arranged in spaced-apart pairs 9, 11, 13, etc., which are sealed around their edges so as to provide respective sealed units, save only for ducting for inflow and outflow of the first fluid as will be described further herein below.

The pairs of plates are also mutually spaced apart providing spacings 15, 17, 19, etc., therebetween which constitute a fluid flow path for a second fluid which thus flows over the outsides of the plate pairs. The inside of the inflow header 3 communicates with the inside of respective plate pairs 9, 11, 13, etc., by respective flexible tubes 21, 23, 27, etc., which follow a partially curved path from the inside of the lower header 3 to the bottoms of the inside of the plate pairs 9, 11, 13, etc., that opposing lower corners thereof.

The upper opposing corners of the plate pairs 9, 11, 13, etc., are respectively connected from the inside of the plate pairs to the inside of the outflow header 5 via flexible tubes 29, 31, 33, etc., but these tubes follow a shorter and more tightly angled path than that of the lower tubes 21, 23, 27, etc.

High pressure cooling fluid is directed into one end 35 of the lower header 3 as denoted by arrow 37. It then passes through the flexible ducting formed by flexible pipes 21, 23, 27, etc., to the lower corners of the insides of the plate pairs 9, 11, 13, etc., after which it flows upwardly inside the plate pairs to leave via the top corners of those pairs and to be conveyed via the upper flexible tubes 29, 31, 33, etc., to the inside of the upper header 5 to pass out of the end 39 thereof as denoted by arrow 41.

Hot fluid at a pressure equal to or lower than that of the cooling fluid is passed down between the plate pairs as shown by arrow 43, for example from a first plenum chamber to exit at the bottom via another plenum as denoted by arrow 45.

Figure 2:
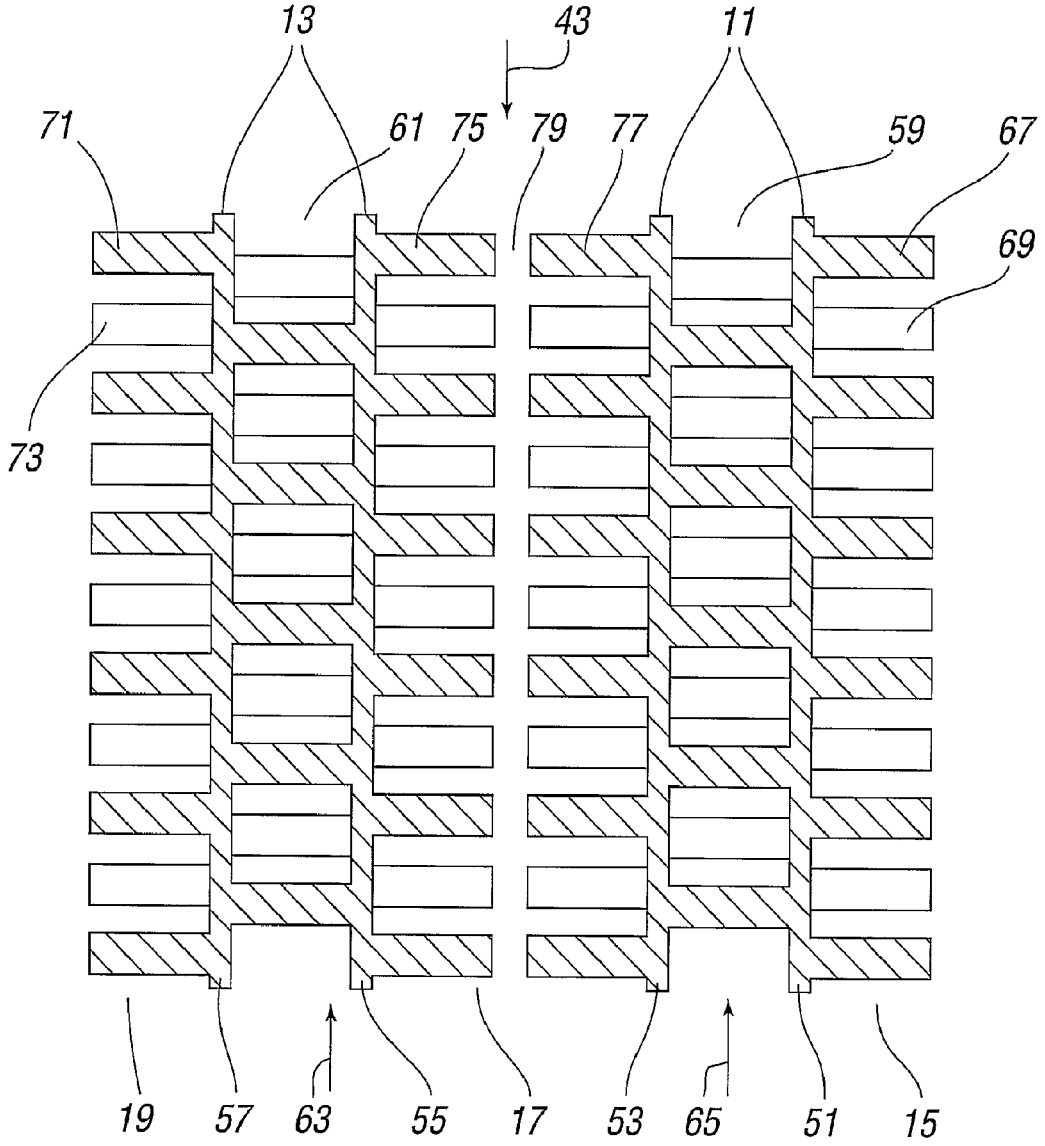
FIG. 2 shows a cross-section through part of two pairs of plates of the heat exchanger shown in FIG. 1, detailing a plate-and-pin arrangement.

As shown now in FIG. 2, the precise form of construction of the plate pairs such as 11, 13 can be seen. The other plate pairs (not shown) have like construction and only part of the length of the plate pairs is shown in FIG. 2.

These plate pairs 11, 13 consist of respective first and second plates 51, 53 and 55, 57. High pressure cold fluid is injected into the respective spaces 59, 61 between the plates 51, 53 and 55, 57, etc., respectively, from the tubes 23, 27, etc. This is shown by the arrows 63, 65. At the same time, the low pressure hot fluid is injected into the spaces outside the plates as denoted by the arrow 43.

Each pair of plates 11, 13, etc. has arranged there through, a plurality of pins 67, 69, etc. and 71, 73, etc. These pins both bridge the spaced apart plates 51, 53 and 55, 57, etc., and also extend into the spacings 15, 17, 19, etc., between the plate pairs. However, the ends 75, 77, etc., of the pins do not actually touch but in each spacing between the plate pairs, they face each other end-to-end but separated by gaps 79, etc., therebetween.

Figure 3:
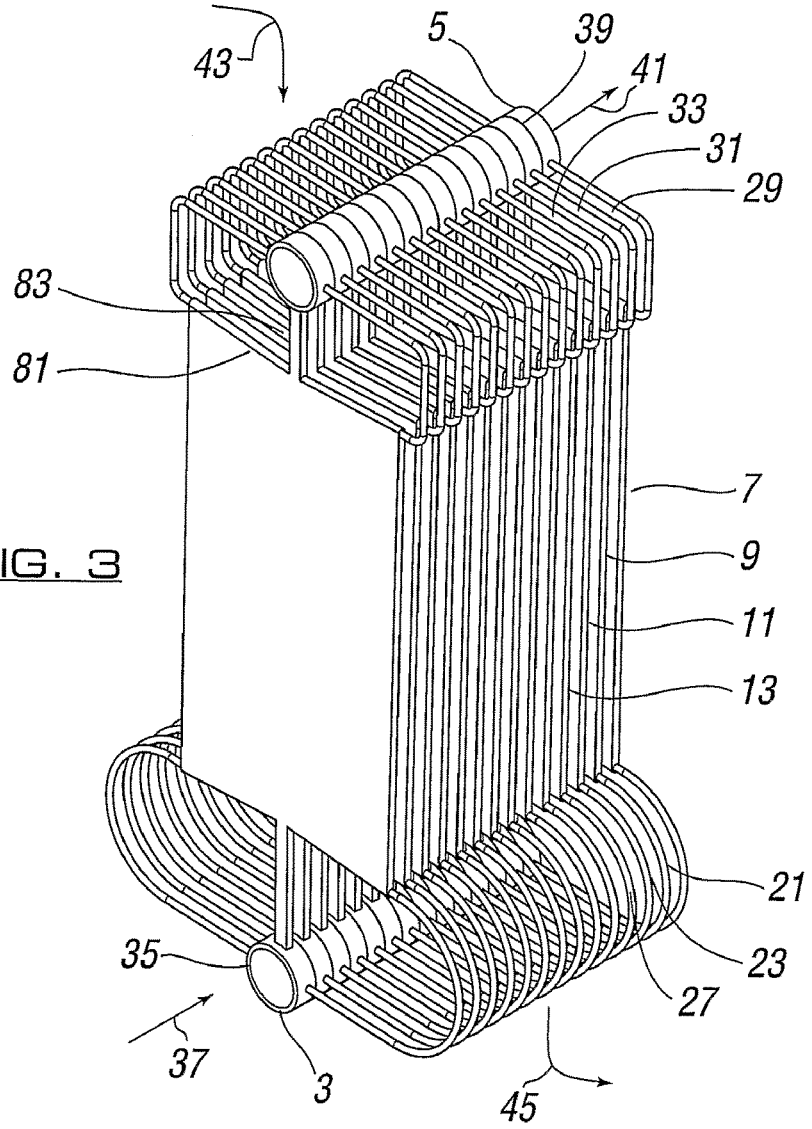
FIG. 3 shows a variant of the embodiment depicted in FIG. 1, having support struts between the plates and headers.

A variation of the embodiment shown in FIG. 1 is depicted in FIG. 3. Here, the same reference numerals are used for like integers. The difference is that the upper header 5 is connected to the upper edges 81, etc., of the plate pairs by respective connection members 83, etc. Similarly, the lower header 3 is connected to the lower edges 85, etc., by respective lower connection members 87, etc.

Figure 4:
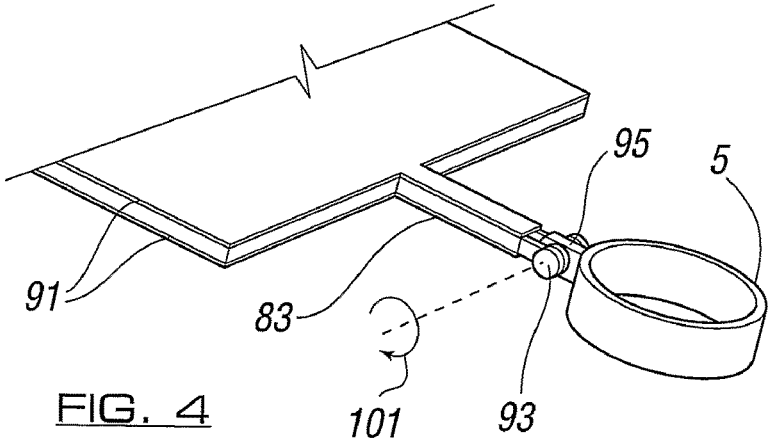
FIG. 4 shows a cross-sectional detail of a hinging arrangement of the struts of the heat exchanger shown in FIG. 3.

In a preferred form of construction, connection members 83, etc., have the form of construction shown in FIG. 4 which depicts just one of these members 83. Here, the connection between the upper edges 85, 87 of a plate 91 is made to the upper header 5 by the connection member 83. This member 83 comprises a hinge pin (not visible) passing through the member 83 and a lug 95, forming part of the header 5. In use, the rotational motion between the plate pair which includes plate 91 and the header 5 is thereby permitted, as depicted by arrow 101.

Figure 5:
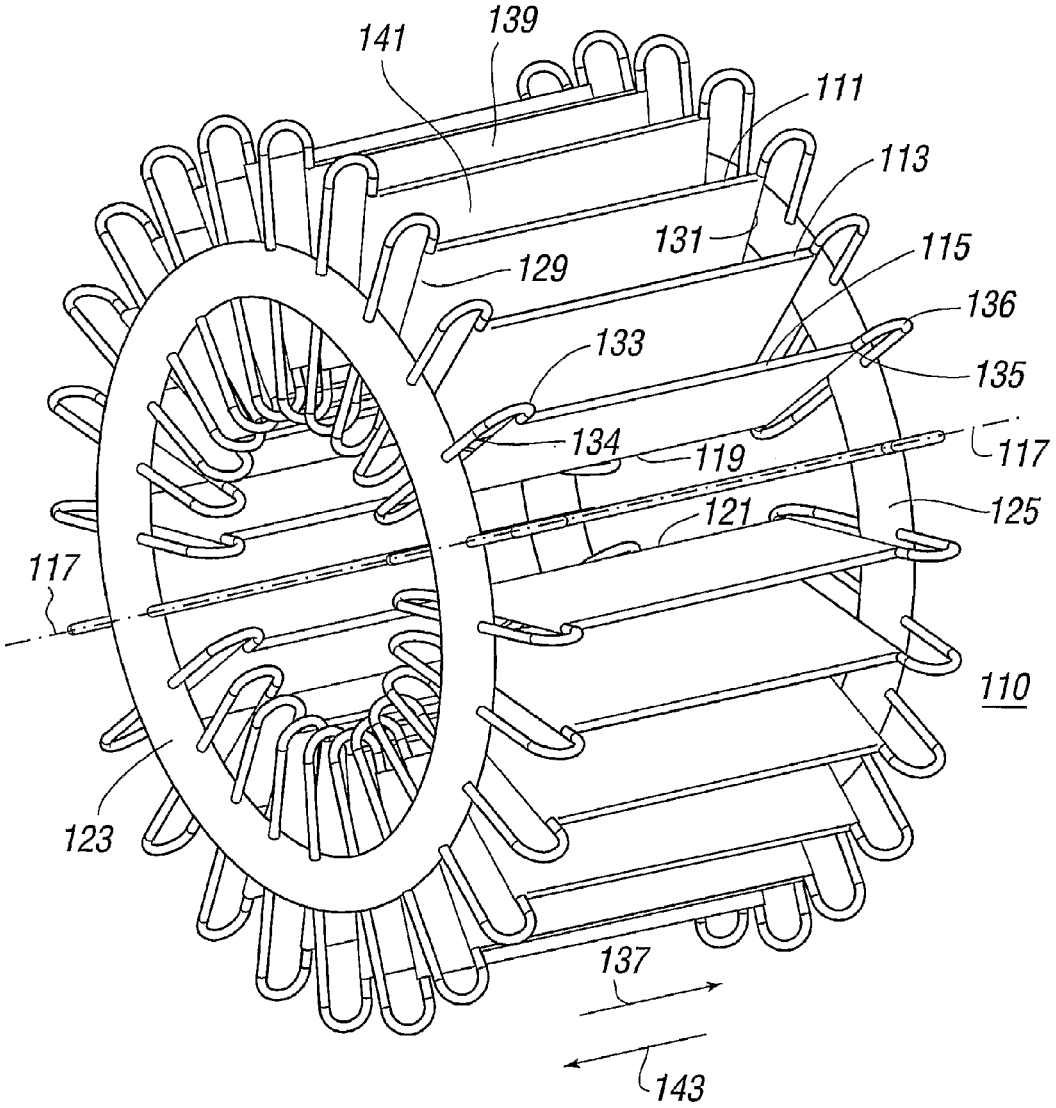
FIG. 5 shows a cylindrical (radial) embodiment of a heat exchanger according to the invention, designed for axial flow.

FIG. 5 shows a second embodiment of a heat exchanger 110 according to the present invention. A plurality of planar plate pairs 111, 113, 115, etc., are arranged in radial fashion around an axis of symmetry 117. The whole arrangement is thereby generally cylindrical but with a space through the middle of the arrangement bounded by the inner edges 119, 121, etc. of the plate pairs.

The plate pairs 111, 113, 115, etc., are also provided with pins in the manner shown in FIG. 2 but for clarity, these are omitted from the drawing of FIG. 5.

Annular headers 123, 125 are respectively arranged adjacent the end edges 129, 131, etc., of the plates such as shown for plate 113 in FIG. 5. These headers are supplied by a source of high pressure cooling fluid (not shown). They feed the high pressure fluid into the corners 133, 135, etc., (as shown for plate 115) via flexible tubes 134, 136 in the same manner as depicted in FIGS. 1 and 3.

If header 23 constitutes the source of high pressure hot fluid and header 125 represents the outflow of that fluid, then high pressure flow is in the direction depicted by arrow 137 and low pressure flow is through the spaces 139, 141, etc., between the plates in the direction of the arrow 143.

Figure 6:
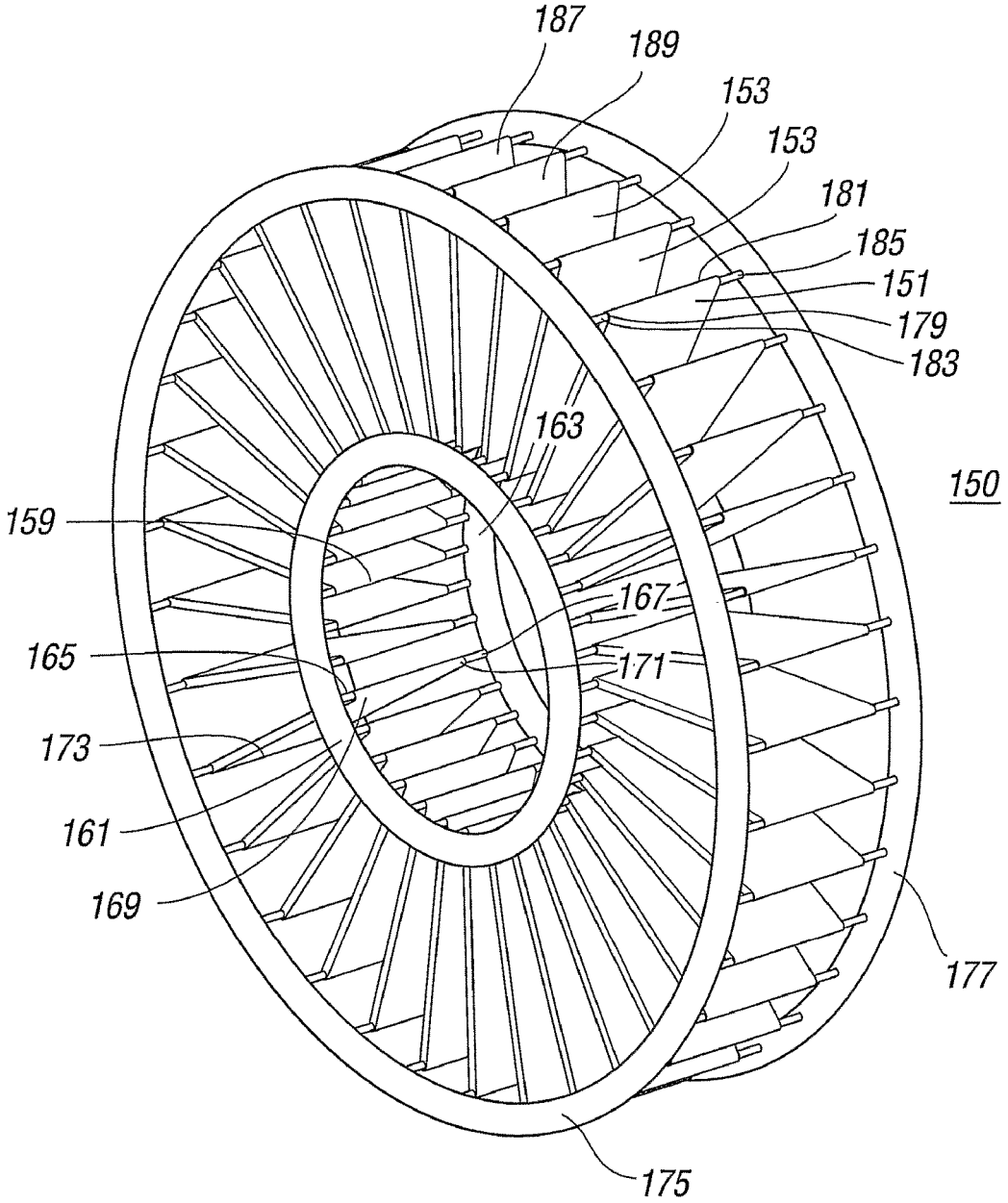
FIG. 6 shows a configuration of a heat exchanger according to the present invention, adapted for radial flow.

FIG. 6 shows another embodiment of a heat exchanger 150 according to the present invention which is analogous to that shown in FIG. 5 in that a plurality of planar plate pairs 151, 153, 157, etc., are arranged in radial fashion with their innermost edges 159, etc., facing inwardly towards a central space. Thus, again, a cylindrical configuration is adopted. In this arrangement, a pair of inner annular headers 161, 163 are arranged and connected by flexible tubes 165, 167, etc., to the corners 169, 171, etc., of the plates, such as shown for one plate 173. A pair of outer annular headers 175, 177 is also provided, respectively connected to the outermost corners 179, 181, etc., of plates 151 etc by means of flexible connections 183, 185, etc. Thus, high pressure cooling fluid may be directed radially through the insides of the plate pairs, either outside to inside or vice versa. Counter-flow low pressure hot fluid may similarly be passed radially through the spaces 187, 189, etc., between the plates by suitable manifold means (not shown).

Figure 7:
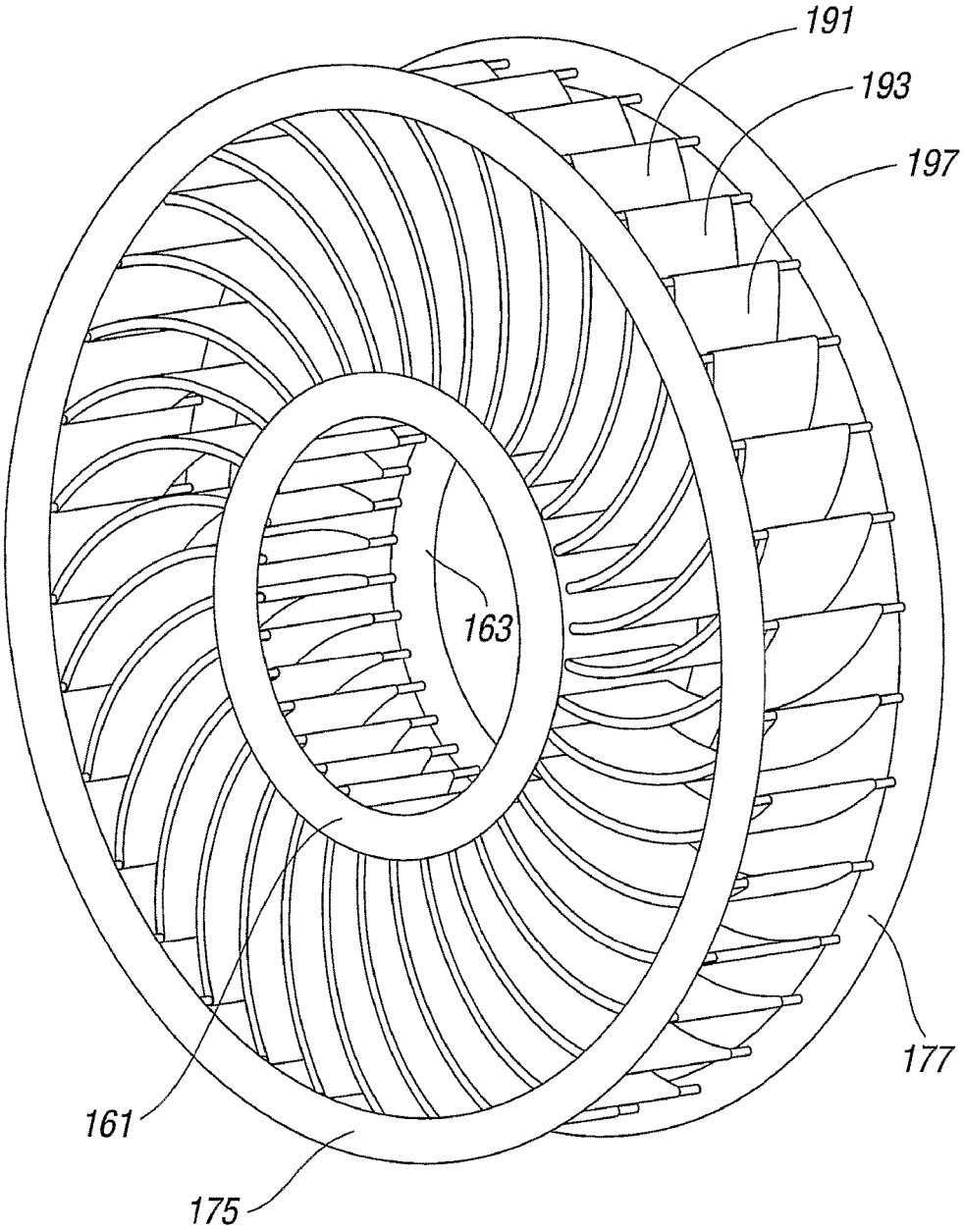
FIG. 7 shows another embodiment of a heat exchanger according to 10 the present invention, analogous to that shown in FIG. 6 but with curved plates in involute form.

FIG. 7 shows another arrangement 190 like that in FIG. 6 for radial flow. The same reference numerals are used for like integers but instead of planar plate pairs 151, 153, 157, there are provided curved plate pairs 191, 193, 197, etc., in involute form. Operation is essentially analogous to that for the embodiment shown in FIG. 6.

Figure 8:
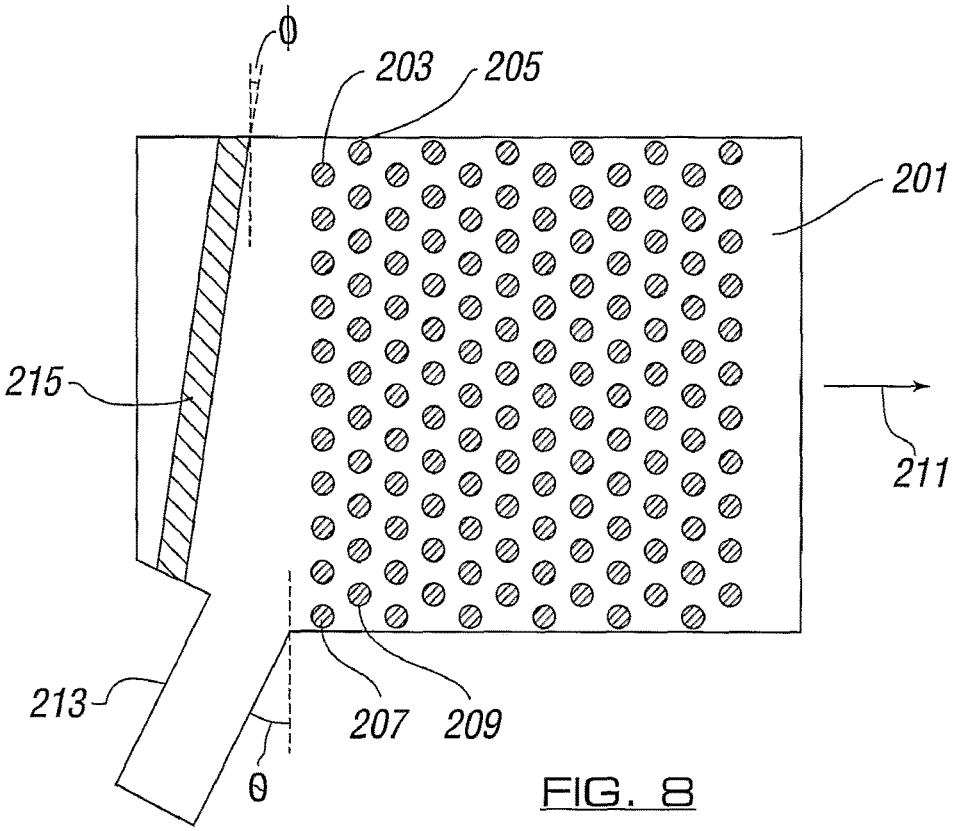
FIG. 8 shows a detail for directing inflow of high pressure fluid into a heat exchanger according to the present invention.

FIG. 8 shows one preferred form of high pressure feed to the spaces between the plates. A partial cross-section of the space between two adjacent plates such as a plate 201 is shown. Rows 203, 205, etc., of pins 207, 209 are arranged so that the pins in one row are staggered relative to the pins in each adjacent row and the rows run in a direction at right angles to the general direction of high pressure flow between the plates as denoted by arrow 211. One of the flexible tubes denoted by numeral 213 for directing high pressure fluid into the gap between the plates 201 and its adjacent plate (not shown) is positioned to inject the high pressure fluid at an angle $\theta$ with respect to the lines of rows of pins so that relative to the direction of high pressure flow denoted by arrow 211, the high pressure fluid is injected at an angle of approximately 25°.

A baffle 215 is also situated between the plates at an angle $\phi$ relative to the direction of the rows of pins to assist in bending the fluid flow towards the direction 211 of flow between the plates.

Figure 9:
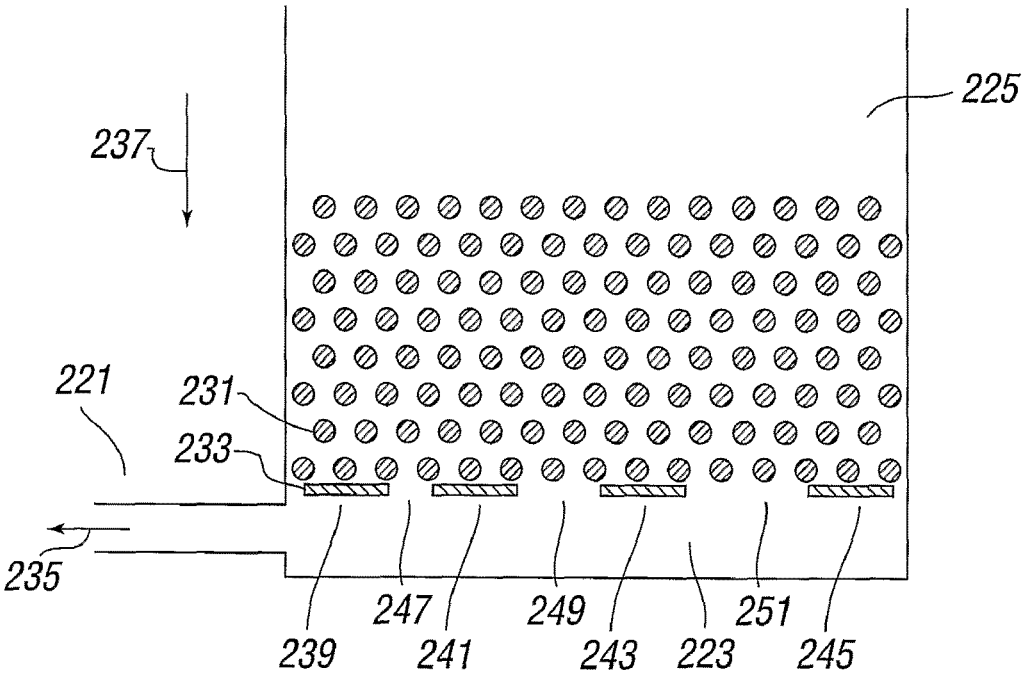
FIG. 9 shows an arrangement for directing outflow of high pressure 15 fluid out of a heat exchanger according to the present invention.

Instead of, or in addition to using the angle baffle plate 215 to direct inflow as shown in FIG. 8, a means of directing the flow from the heat exchanger core into the outflow flexible tubes is shown in FIG. 9. As depicted in this drawing, a flexible connector tube 221 communicates with an exit zone 223 between a pair of plates, only the lower plate 225 being shown. The plate pair is bridged by rows 227, 229, etc., of pins 231, 233, etc., again, as with the arrangement of FIG. 8, the pins in adjacent rows being staggered relative to one another.

The direction of high pressure fluid flow outflow is indicated by arrow 235, 237 being the arrow indication of the direction of high pressure flow in the space between the plates. Baffle plates, bridging the main plates 225, etc., of the plate pair, block regions of exit of fluid from the pin matrix, as denoted by numerals 239, 241, 243 and 245. However, gaps are situated between these baffle plates to allow the fluid to exit the pin matrix. These gaps 247, 249, 251, etc., become progressively wider as distance from the outflow flexible pipe 221 increases. This arrangement thereby fulfils essentially the same function as that of the continuous baffle plate 215 as depicted in the embodiment of FIG. 8, but in reverse.

Figure 10:
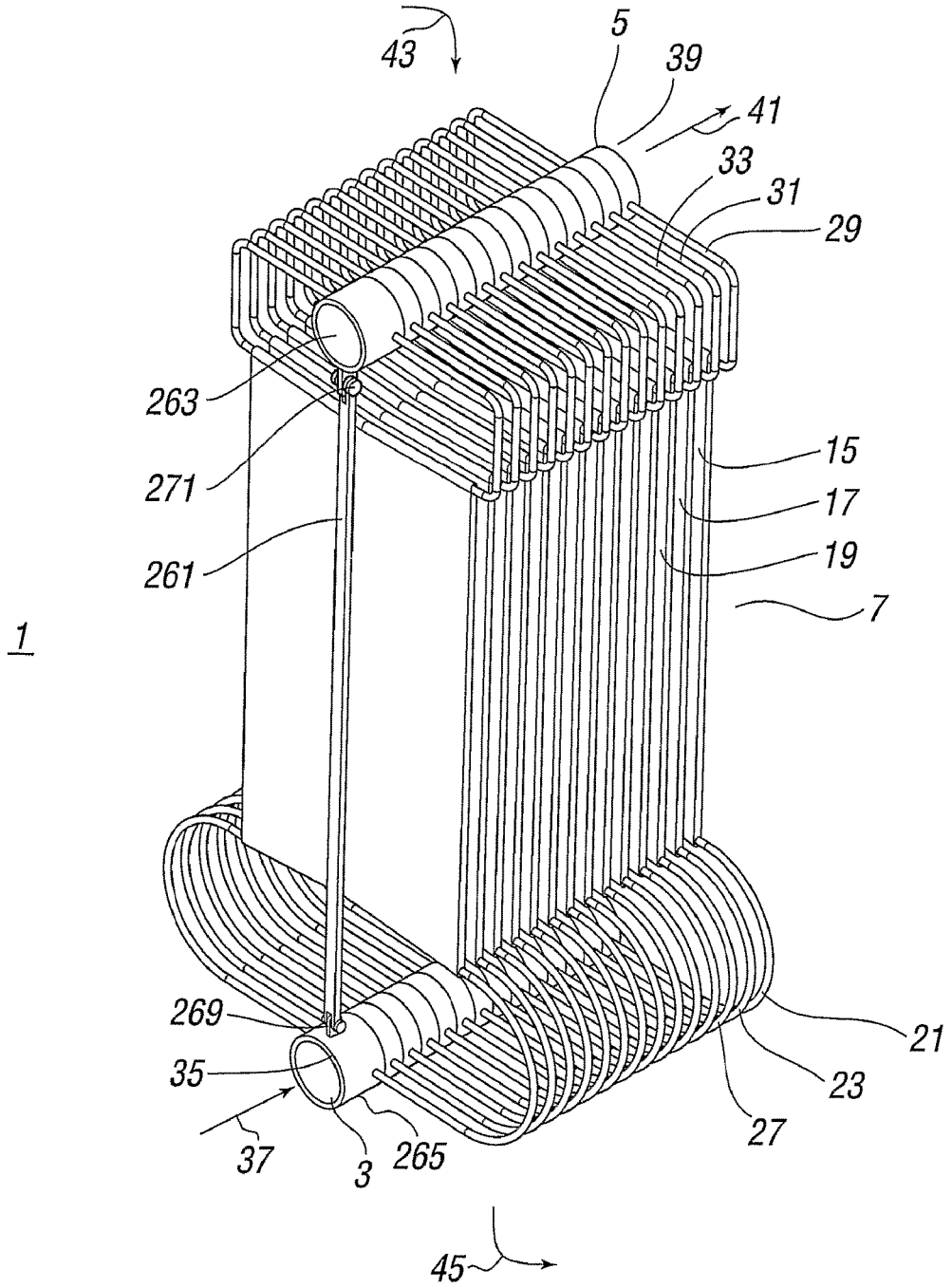
FIG. 10 shows a variant of the embodiment of FIG. 1, employing pusher bars.

FIG. 10 shows a modification of the embodiment of FIG. 1. In FIG. 10, the same reference numerals are used to depict like integers which appear in FIG. 1. However, in this variant, a pair of pusher bars connects the two headers 3, 5. The first pusher bar 261 connects one end 263 of the upper header 5 with the corresponding end 265 of the lower header 3. A second pusher bar (not visible) connects the other end 267 of the upper header 5 with the corresponding end (not visible) of the lower header 3.

Hingeable connection is made at the point of connection with the lower header 3 as denoted by numeral 269 and at the point of connection with the upper header 5, as denoted by numeral 271.

Figure 11:
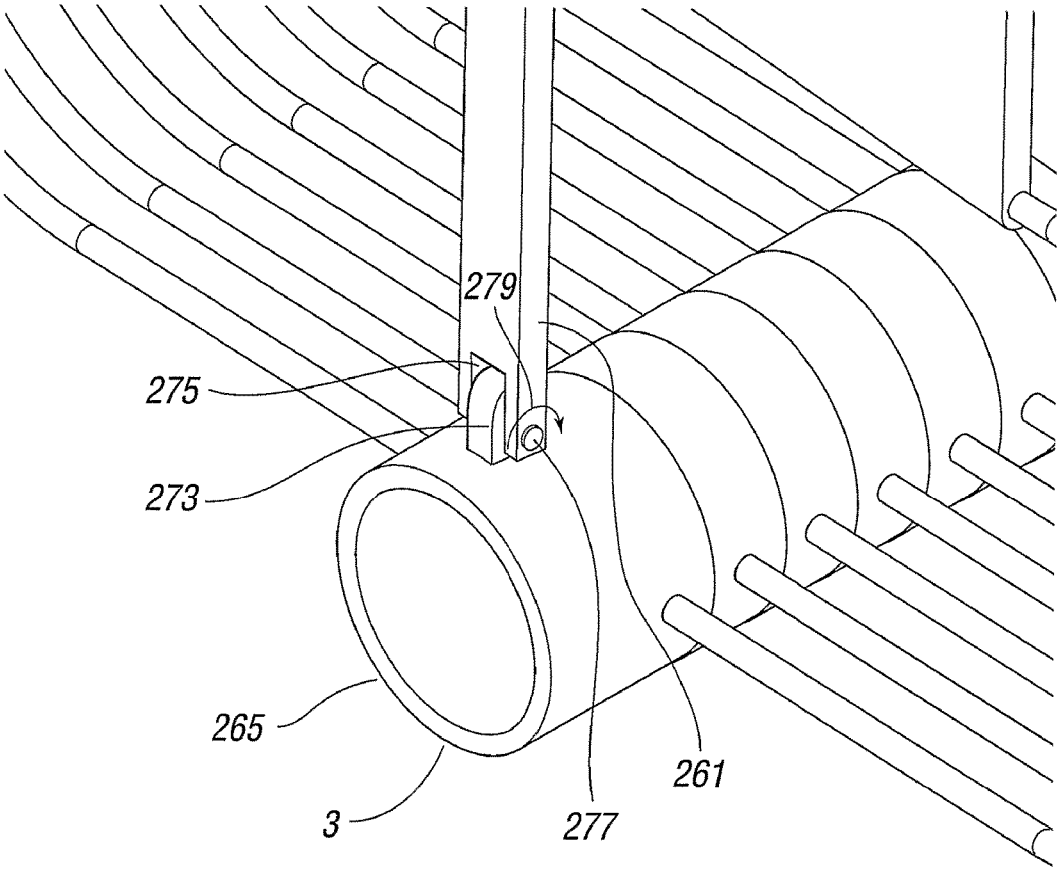
FIG. 11 shows a detail of the variant of FIG. 10, depicting the hinging of the pusher bars.

A detail of this hingeable connection 269 between the pusher bar 261 and the lower header 3 is shown in FIG. 11. A lug 273, which is part of the lower header 3, is situated in a space 275 formed in the lower part of the pusher bar 261 and a hinge pin 277 passes through the pusher bar and lug. Thereby, rotational motion around the axis of the pin which is orthogonal to the axis of symmetry of the headers, is permitted as depicted by arrow 279.

Figure 12:
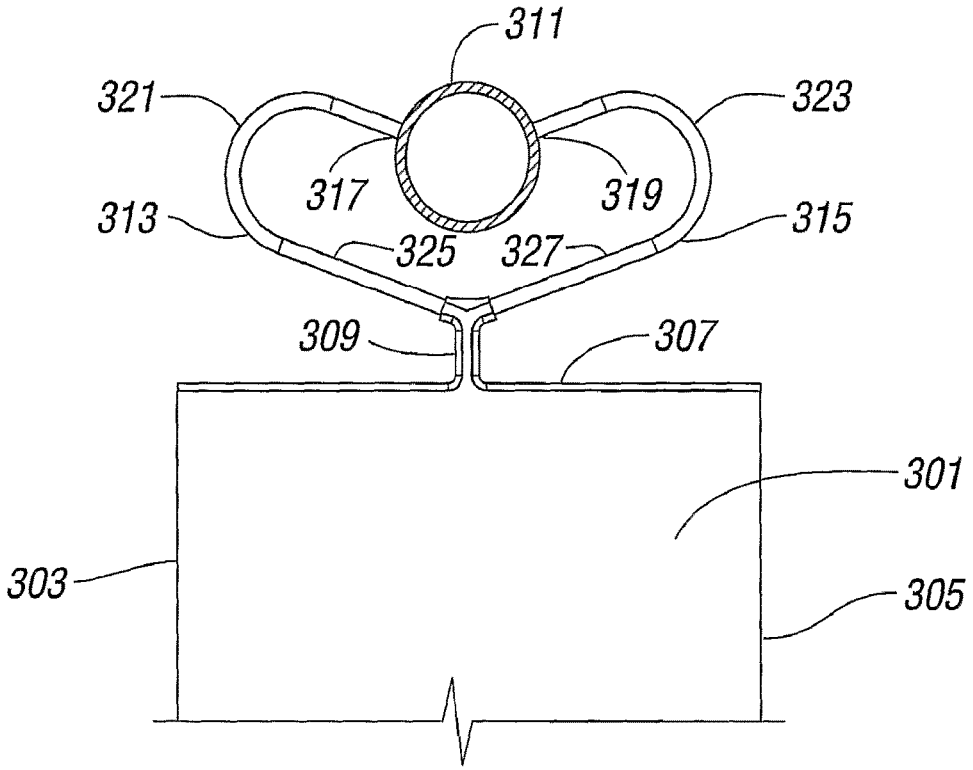
FIG. 12 shows a partial cross-section through an embodiment of a heat exchanger according to the present invention, having a first alternative arrangement of tubular interconnection between the header and the body of the heat exchanger.

A partial cross-section of another embodiment heat exchanger according to the present invention is shown in FIG. 12. This embodiment is substantially the same as that shown in FIG. 1, except that at the inflow (cold) end, the 10 shape of the tubes (equivalent to integers 21, 23, 27 in FIG. 1) is different. Optionally, the same shapes may also be adopted for the tubes connecting the heat exchanger cells and the outflow (hot end) header.

In FIG. 12, there is shown a single plate 301, which is seen from the outside, i.e. the surface visible is in the second fluid flow path. The plate comprises a left hand side 303 and a right hand side 305, which sides are substantially parallel to the direction of fluid flow in the first fluid flow path. They are interconnected by a connecting side 307 which is nearly at right angles to the two sides 303, 305. A connecting duct 309 channels fluid into the first fluid flow path at a position substantially midway along the connecting side 307. The communal central duct 309 into the first fluid flow path, from the header 311, via two flexible connecting tubes, designated by numerals 313 and 315 respectively. These tubes leave the header at the respective positions 317 and 319 and are bent via respective curved portions 321, 323 which lead into respective straight portions 325, 327 which interconnect with the central duct 309. The curved portions 321, 323 bend the tubes through substantially 180°.

Figure 13:
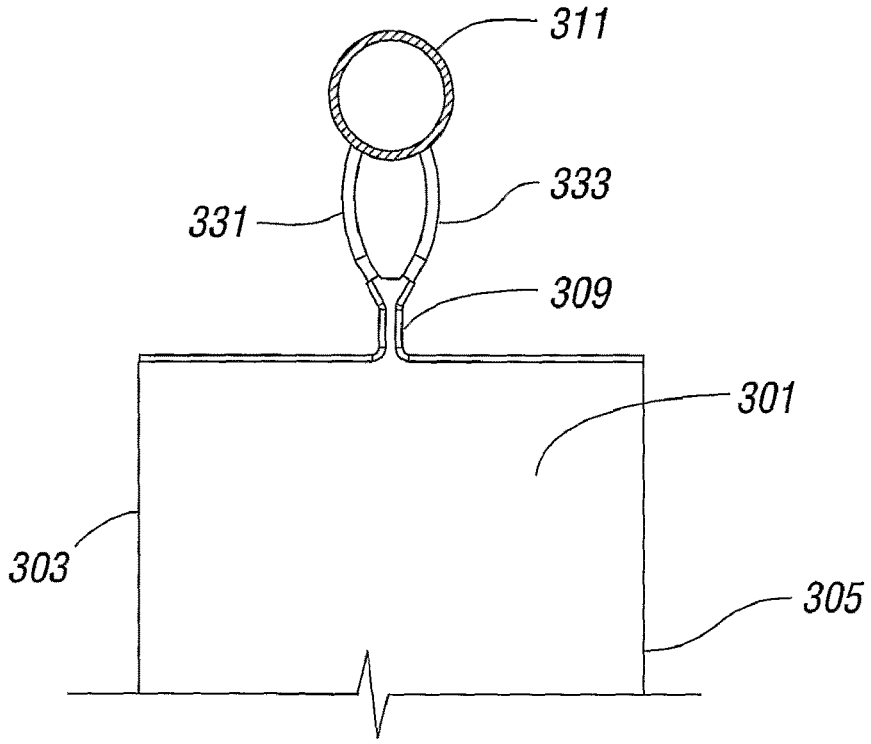
FIG. 13 shows a partial cross-section through another embodiment of heat exchanger according to the present invention with a second alternative arrangement of interconnection between the header and body of the heat exchanger.

FIG. 13 shows an arrangement similar to that in FIG. 12 and the same reference numerals are used to denote like features. However, in this case, the header 311 is linked to the central duct 309 by respective tubes 331, 333, which have only slight curvature along substantially their entire length and bend through an angle of approximately 20° overall.

Figure 14:
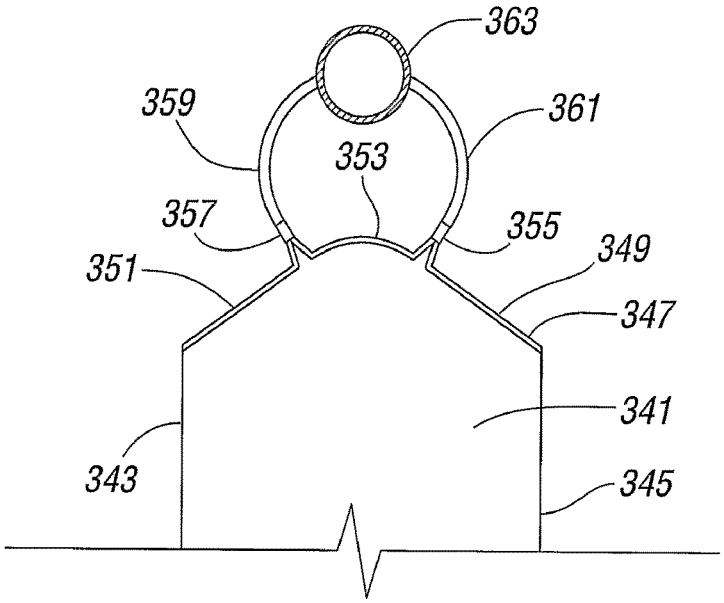
FIG. 14 shows a partial cross-section through yet another embodiment of a heat exchanger according to the present invention with a third alternative configuration of interconnection between the header and the body of the heat exchanger.

FIG. 14 shows another alternative arrangement. The components are analogous to the embodiments shown in FIGS. 12 and 13 except in this case, the plates, one of which is designated by numeral 341, has left and right substantially straight sides 343, 345, substantially parallel to each other and to the direction of flow in the first fluid flow path but joined by a different shape of connecting side. The outer surface of a cell is constituted by the plate 341 and is therefore in a second fluid flow path. In this case, the two sides of the plate are joined by a connecting side 347 which is substantially symmetrical and has two outwardly directed substantially straight side portions 349, 351 which are joined by a convex curve portion 353. The region of transition between the straight portions 349, 351 of the connecting side 347 and the convex portion 353 have protrusions 355, 357 respectively, which constitute the point of entry of cold fluid into the space between the plates which is the first fluid flow path. These points of interconnection are connected by regularly curved tubes 359, 361 (having outward curvature) to provide a fluid flow path from a header 363 into the first fluid path in the body of the heat exchanger.

Figure 15:
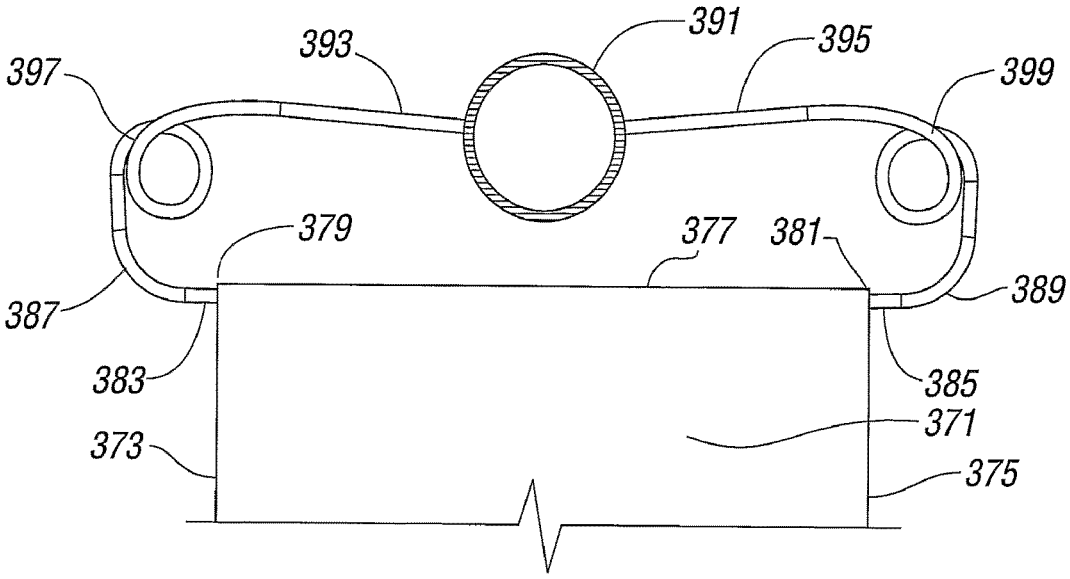
FIG. 15 shows a still further embodiment of a heat exchanger according to the present invention, having a fourth alternative configuration of tubular interconnection between the header and the body of the heat exchanger.

The alternative arrangement shown in FIG. 15 has substantially rectangular plates, one of which is shown from the outside (second fluid flow path view) as designated by reference numeral 371. It has opposite sides 373, 375 which are substantially parallel to each other and to the direction of flow in the first fluid flow path. The sides are interconnected by a connecting side 377. Into the first fluid flow path at the corners 379, 381 of the plate 371 (between the two sides 373, 375 and the connecting side 377) are connected inflow ducts 383 and 385 respectively. These connect to the corners of the cell on the sides 373, 375. These inflow ducts 383, 385 are contiguous with respective tubes 387, 389 which convey fluid from a header 391. Each tube 387, 389 comprises an approximately straight portion 393, 395 extending from the header 391 and then at the position of a 90° turn towards the heat exchanger plate, each is provided with a single helical turn 397, 399, after which each tube 387, 389 joins the entry ducts 383, 385.

In all of the embodiments of FIGS. 12-15, each plate has substantially the same shape, and the tubes connecting the headers and the cells also have substantially the same shape. Optionally, the same configuration of the interconnecting tubes is used at the outflow end, or alternatively, they may have the shape of the outflow tubes shown in the embodiment of FIG. 1.

Figure 16:
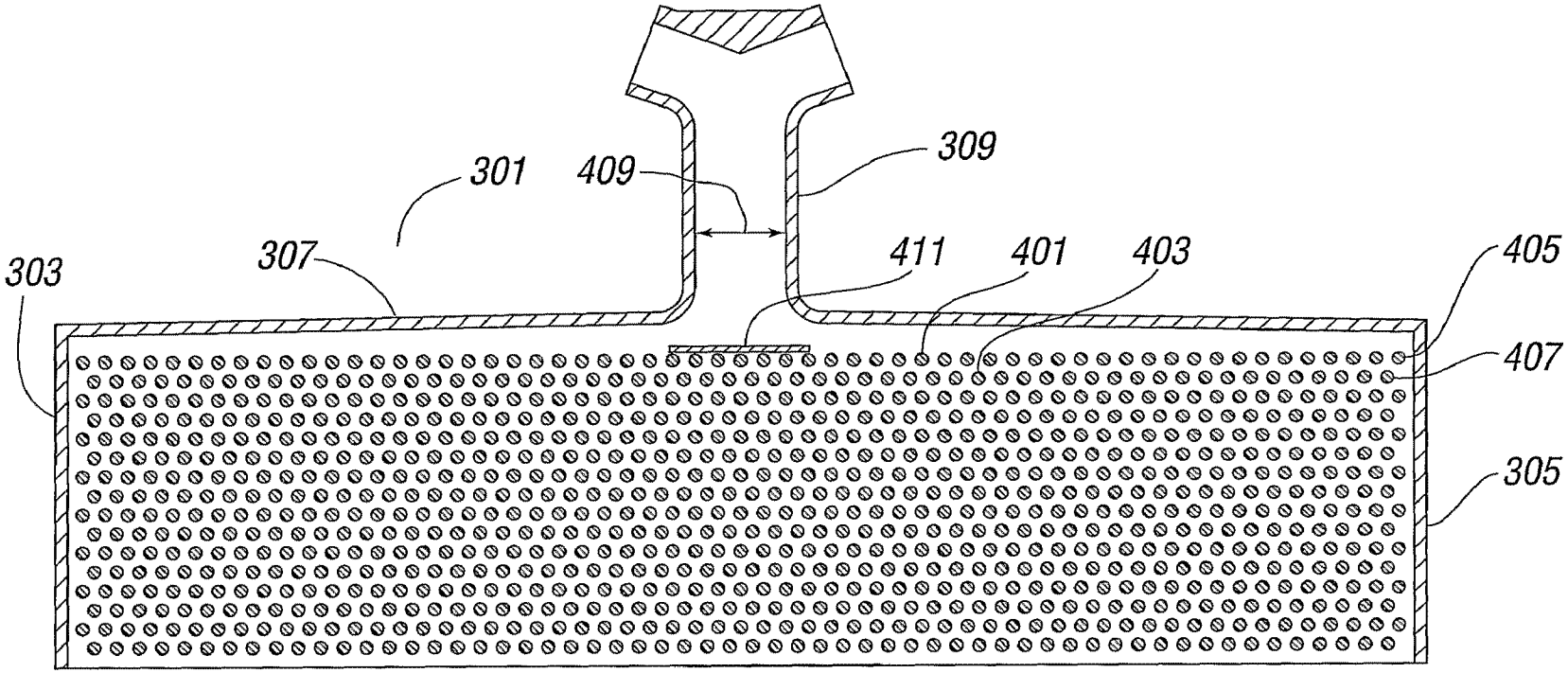
FIG. 16 shows a partial cross-section through a heat exchanger of FIG. 12, depicting the inflow arrangement within a cell.

FIG. 16 depicts how air may be directed in a heat exchanger having the form of construction shown in FIG. 12. More visible in FIG. 16 than in FIG. 12 is the fact that the connecting side 307 is not absolutely straight along its length but is angled slightly outwardly from each end towards the central duct 309. Also the plane of cross-sectional cut is different from that in FIG. 12. The plane of cut is between plates of the first fluid flow path. Arranged inside the (and each other) cell is arranged pins protruding orthogonally to each plate within the cell. The pins, depicted by numerals 401, 403, etc., are arranged in rows 405, 407, etc. The pins in each row are offset relative to the pins in each other row, in the manner depicted in, for example, FIGS. 8 and 9. A baffle plate 411 is provided across the first row of pins 405 at the midpoint of that row, opposite the inflow aperture 409 of the inflow duct 309 and has a width just a little greater than that inflow aperture 409. This enables the fluid entering the cell to be dispersed along the rows of pins so that flow is made more nearly uniform across the width of the cell.

In the light of the described embodiments, modifications of those embodiments, as well as other embodiments, all within the scope of the present invention as defined by the appended claims, will now become apparent to persons skilled in the art.

The invention claimed is:

1. A heat exchanger comprising a stack of mutually spaced apart plates separated by respective spacings therebetween, wherein alternate spacings respectively provide a flow path for a first fluid, hereinafter the first fluid flow path, and a flow path for a second fluid, hereinafter the second fluid flow path, the heat exchanger further comprising a first header and a second header, the first header for inflow of the first fluid and the second header for outflow of the first fluid, wherein respective cells are formed by opposed pairs of the plates, the spacing between the plates of these pairs constituting all or part of the first fluid flow path, and the spacing between the respective cells constituting all or part of the second fluid flow path, the first and second headers being connected to the stack, wherein at a first end of the first fluid flow path the first header is connected to the stack by flexible tubular ducting in the form of metallic tubes which connect each cell with said first header, the ducting providing fluid flow between the cells and said first header, as well as a mechanical connection therebetween which maintains strength and yet is able to flex by virtue of being arranged to follow a tortuous path, the flexibility of the ducting permitting independent flexing of cells relative to said first header during heat exchanger start-up and operation, wherein the cells are also connected to said first header by at least one support member, the at least one support member not conveying fluid and comprising a joint that enables relative movement between said first header and the respective cells, with at least one degree of freedom.

2. The heat exchanger of claim 1, wherein the joint comprises a first jointing arrangement at a first end of the heat exchanger, allowing one or more rotational degree of freedom and at least one translational degree of freedom.

3. The heat exchanger of claim 1, wherein said metallic tubes connect each cell with said first header in pairs and the shapes in each pair are symmetrical about an axis of symmetry.

4. The heat exchanger of claim 3, wherein the axis of symmetry is substantially parallel to the direction of fluid flow in the first fluid flow path.

5. The heat exchanger of claim 1, wherein the tortuous path comprises a curved portion.

6. The heat exchanger of claim 1, wherein the tortuous path comprises a portion having at least one helical turn.

7. The heat exchanger of claim 1, wherein the tortuous path comprises at least one angled region.

8. The heat exchanger of claim 1, wherein the plates have two opposite sides substantially parallel to the direction of the first fluid flow path and are joined respectively by two connecting sides at each end of the first fluid flow path and the metallic tubes communicate with the spacings defining the first fluid flow path at one or both of the two opposite sides.

9. The heat exchanger of claim 8, wherein the metallic tubes communicate with the spacings defining the first fluid flow path at one or both of the two opposite sides substantially parallel to the direction of the first fluid flow path.

10. The heat exchanger of claim 1, wherein the plates have two opposite sides substantially parallel to the direction of the first fluid flow path and are joined respectively by two connecting sides at each end of the first fluid flow path and the metallic tubes communicate with the spacings defining the first fluid flow path at one or both connecting sides.

11. The heat exchanger of claim 10, wherein the metallic tubes communicate with one or both connecting sides via a common duct.

12. The heat exchanger of claim 1, wherein the mean hydraulic diameter of each metallic tube is from 0.5 to 2 times the average plate-to-plate distance of the spacings representing the first fluid flow path.

13. The heat exchanger of claim 1, wherein the average length of the metallic tubes is from 0.1 to 2 times the width of the plates normal to the flow direction of the first fluid flow path.

14. The heat exchanger of claim 1, wherein the ducting is arranged to direct inflow of the first fluid to the spacings defining the first fluid flow path in a direction from 90° to 30° relative to the direction of flow in the first fluid flow path.

15. The heat exchanger of claim 14, wherein an inflow diverters is located at or near the entry region of the spacings defining the first fluid flow path to enhance uniformity of flow in said fluid flow path.

16. The heat exchanger of claim 14, wherein an outflow diverters is located at or near the exit region of the spacings defining the first fluid flow path, to enhance uniformity of flow out of said first fluid flow path.

17. The heat exchanger of claim 1, wherein the plates are provided with surface projections for enhancing heat transfer.

18. The heat exchanger of claim 17, wherein the plates are arranged in a plurality of groups each comprising at least two plates, the surface projections being in the form of a plurality of groups of pins, the pins in each group being arranged to bridge plates of a respective plate group.

19. The heat exchanger of claim 18, wherein the groups of plates are formed by the opposed pairs of plates from the respective cells.

20. The heat exchanger of claim 1, wherein the first header is connected to a source of the first fluid, ducting being provided for feeding the second fluid from a source of the second fluid to the second fluid flow path, wherein the first fluid at source has a pressure equal to or greater than that of the second fluid at source.

21. The heat exchanger of claim 1 wherein said first header is at a cold end of the cells.

22. The heat exchanger of claim 1, fabricated as a modular arrangement, the stack being a module or unit comprising a fraction of the total number of plates in the heat exchanger.

23. A heat exchanger comprising a stack of mutually spaced apart plates separated by respective spacings therebetween, wherein alternate spacings respectively provide a flow path for a first fluid, hereinafter the first fluid flow path, and a flow path for a second fluid, hereinafter the second fluid flow path, the heat exchanger further having first and second headers, the first header for inflow of the first fluid and the second header for outflow of the first fluid, wherein respective cells are formed by opposed pairs of the plates, the spacing between the plates of these pairs constituting all or part of the first fluid flow path, and the spacing between the respective cells constituting all or part of the second fluid flow path, the first and second headers being connected to the stack, wherein at a first end of the first fluid flow path the first header is connected to the stack by flexible tubular ducting in the form of metallic tubes which connect each cell with said first header, the ducting providing fluid flow between the cells and said first header, as well as a mechanical connection therebetween which maintains strength and yet is able to flex by virtue of being arranged to follow a tortuous path, the flexibility of the ducting permitting independent flexing of cells relative to said first header during heat exchanger start-up and operation, wherein the stack includes at least one support member connected to said first header, the at least one support member not conveying fluid and comprising a joint that enables relative movement between said first header and the stack, with at least one degree of freedom.

24. The heat exchanger of claim 23 wherein said first header is at a cold end of the cells.

25. The heat exchanger of claim 23, fabricated as a modular arrangement, the stack being a module or unit comprising a fraction of the total number of plates in the heat exchanger.

* * * * *